United States Patent [19]

Galbierz

[11] 4,402,503

[45] Sep. 6, 1983

[54] EXERCISE BICYCLE

[75] Inventor: Richard T. Galbierz, St. Louis, Mo.

[73] Assignee: The Perfection Manufacturing Company, St. Louis, Mo.

[21] Appl. No.: 257,889

[22] Filed: Apr. 27, 1981

[51] Int. Cl.[3] ..... A63B 23/04; A63B 69/16

[52] U.S. Cl. ..... 272/73; 70/236; 188/31; 194/9 T; 272/132

[58] Field of Search ..... 272/73; 70/233, 174, 70/182, 183, 187, 188, 189, 236, 282, DIG. 41, DIG. 85; 194/9 T, 19, 30, DIG. 19, DIG. 11; 188/69, 31, 83, 106 R, 106 P; 464/45, 46

[56] References Cited

U.S. PATENT DOCUMENTS

| | | | |
|---|---|---|---|
| 509,175 | 11/1893 | Leonard | 70/236 |
| 839,584 | 12/1906 | Hayford et al. | 70/236 |
| 1,190,811 | 7/1916 | Swoyer et al. | 188/31 |
| 2,784,591 | 3/1957 | Shoor | 272/73 X |
| 2,788,211 | 4/1957 | Ivanoff | 272/73 |
| 2,857,750 | 10/1958 | Fox | 464/46 X |
| 3,201,953 | 8/1965 | Firth | 464/66 |

FOREIGN PATENT DOCUMENTS

| | | | |
|---|---|---|---|
| 1126186 | 7/1956 | France | 188/69 |
| 476305 | 12/1937 | United Kingdom | 272/73 |

*Primary Examiner*—Richard C. Pinkham
*Assistant Examiner*—Arnold W. Kramer
*Attorney, Agent, or Firm*—Cohn, Powell & Hind

[57] ABSTRACT

This exercise bicycle includes a frame having a front fork portion supporting a pair of handlebars and mounting a rotatable wheel; a rear ground-engaging support portion, and an intermediate portion supporting the seat and mounting a pedal sprocket. A coin-operated drive resistance assembly is mounted to the rear of the frame, the assembly including a shaft having a sprocket connected thereto by a torque limiter device which sprocket is drivenly connected to the pedal sprocket and the front wheel; a disc brake on the shaft and a hand control for setting the brake for predetermining the resistance of the shaft to rotation; a lock for the shaft including a member rotatable with the shaft, and a coin-operated timer switch for actuating a solenoid to deactivate the lock for unlocking the shaft, the unlocked period being determined by the timer. The torque limiter device permits limited rotation of the sprocket on the shaft and consequently the bicycle pedal sprocket when rotation of the drive assembly shaft is abruptly terminated by the locking of the shaft at the end of the coin actuated time.

17 Claims, 21 Drawing Figures

FIG. 8
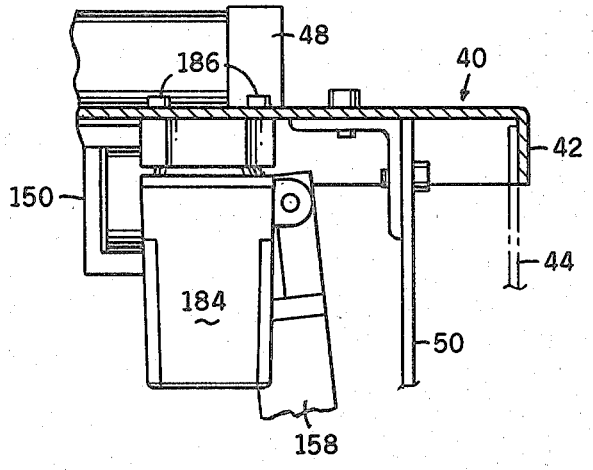
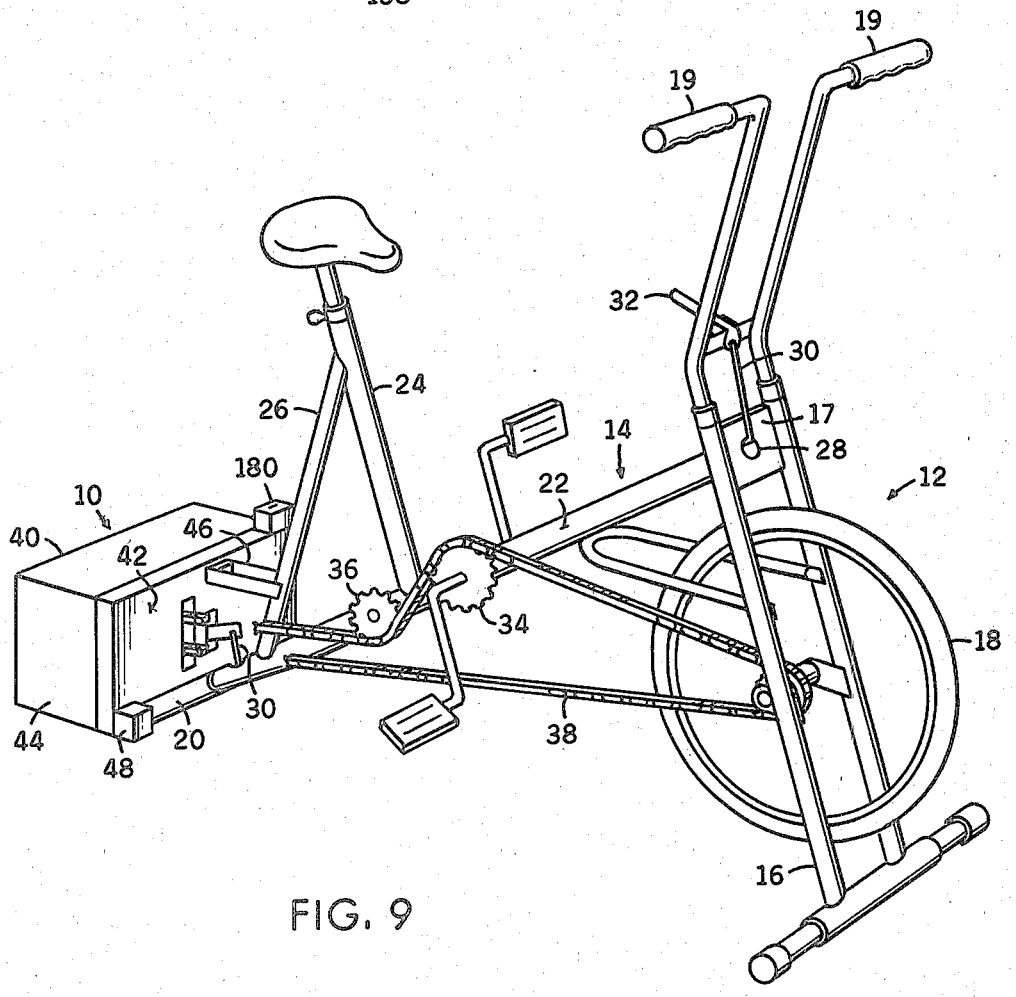
FIG. 9

EXERCISE BICYCLE

BACKGROUND OF THE INVENTION

This invention relates generally to exercise bicycles and particularly to a coin-operated drive resistance assembly for an exercise bicycle.

Exercise bicycles have long been used by athletes and non-athletes alike as an aid to maintaining fitness. In general, such "bicycles" have only a front wheel which is raised from the ground and driven by a chain to simulate the sensation of cycling. Virtually all exercise bicycles are provided with some means of applying frictional resistance to the motion of the front wheel, usually by the application of a pressure roller to the front wheel tire, and in most cases the pressure is variable to suit the particular requirements of the user.

There is a need for a coin-operated exercise bicycle for use by those who wish to maintain their exercise routine while away from home and by those who do not have their own exercise bicycle. However, adapting the driven front wheel of a conventional bicycle to a coin-operated system presents problems because of the difficulty of mounting the drive resistance mechanism on the front wheel, quite apart from the tendency of such an assembly to destroy the illusion of unencumbered cycling. On the other hand, providing a rear wheel drive resistance mechanism demands a radical departure from the conventional exercise bicycle design.

The present coin-operated exercise bicycle overcomes these and other problems in a manner not revealed by the known prior art.

SUMMARY OF THE INVENTION

This coin-operated exercise bicycle provides a compact drive resistance assembly without radical departure from the structure of a conventional exercise bicycle.

The coin-operated exercise bicycle includes a frame having a front fork portion, a rear support portion and an intermediate portion connecting the front and rear portions; a wheel mounted to said front fork portion; a pedal sprocket mounted to the intermediate frame portion; and a drive resistance assembly connected to the pedal sprocket.

The drive resistance assembly includes support means; coin actuated switch means including a timer; a shaft rotatively mounted to the support means; a brake means for selectively applying resistance to rotation of the shaft; lock means actuated by the switch means and operatively engageable with the shaft to lock the shaft; and a drive means operatively connected between the shaft and the exercise bicycle.

In one aspect of the invention the brake means includes a disc attached to the shaft, a brake pad mounted adjacent to the disc and control means for selectively moving the pad translationally into engagement with the disc.

In another aspect of the invention the control means includes a rotatable arm and engagement means between said arm and said brake pad for moving the pad translationally into engagement with the disc, the control means including a flexible pull element attached to the arm to move the arm in one direction and a resilient means tending to urge the arm in the other direction.

In yet another aspect of the invention the lock means includes a first locking member operatively mounted to the shaft for rotation therewith, and a second non-rotatable locking member engageable with the first locking member to substantially preclude relative rotation of said first locking member.

In another aspect of the invention the lock means includes a torque limiter operatively connected to the shaft and the drive means includes an endless flexible element operatively extending between the exercise bicycle and the torque limiter.

In a further aspect of the invention one of the locking members includes an end face defining a groove disposed transversely of the axis of rotation of the shaft, and an abutment disposed adjacent the groove and projecting outwardly of said groove, and the other of said locking members includes an end face defining a tongue disposed transversely to the axis of rotation of the shaft, said tongue being engageable with said abutment and being receivable within said groove.

In still another aspect of the invention the lock means includes a solenoid having a movable core and lever means pivotally mounted to the support means and connected between the solenoid core and the second locking member for moving said locking members into and out of engagement and in a further aspect of the invention the lock means includes resilient means tending to urge the second locking member into engagement with the first locking member.

BRIEF DESCRIPTION OF THE DRAWINGS

FIG. 8 is a fragmentary plan view illustrating the timer;

FIG. 9 is a perspective view of an exercise bicycle incorporating the drive assembly;

FIGS. 14A–17A are composite views taken on lines 14A—14A through 17A—17A of FIGS. 14 through 17 respectively.

DESCRIPTION OF THE PREFERRED EMBODIMENT

Figure 1:
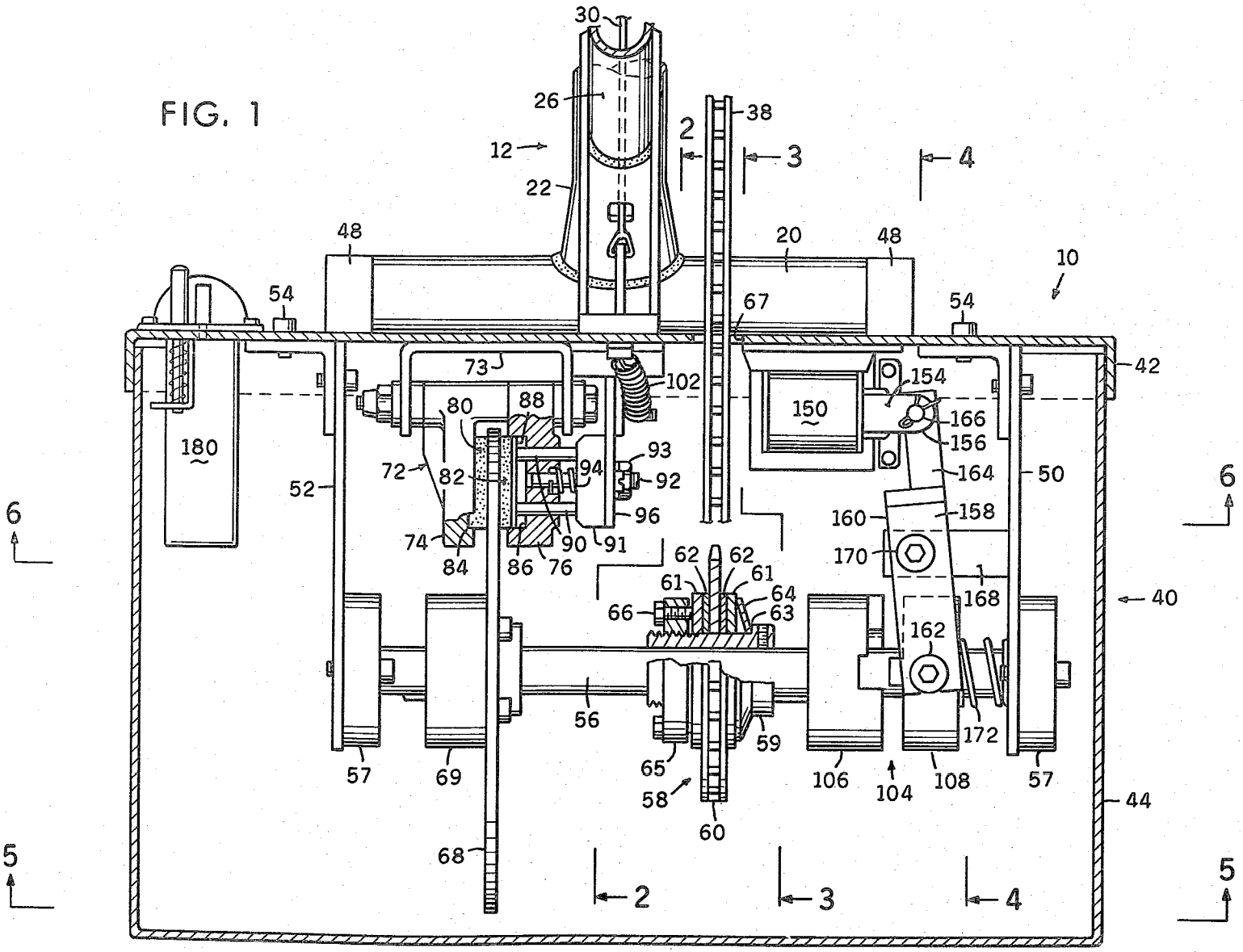
FIG. 1 is a plan view of the drive assembly.

Referring now by reference of numerals to the drawings and first to FIGS. 1 and 9 it will be understood that the coin-operated drive assembly 10 is used in conjunction with an exercise bicycle 12 for the purpose of providing a resistance to rotary pedal action by the user of said bicycle.

As particularly shown in FIG. 9, the exercise bicycle includes a frame 14 having a front fork portion 16 provided with a connection plate 17 and supporting handle bars 19. A ground engaging transverse bar 20 provides the rear portion of the frame 14 and an intermediate portion is provided consisting essentially of an inclined member 22, and seat supporting members 24 and 26. The inclined frame member 22 is attached to the connection plate 17, said plate having an aperture 28 communicating with the member 22 for receiving a pull cord 30 operated as by a handle bar mounted trigger 32. The inclined frame member 22 also provides a mounting for a pedal sprocket 34 and an idler sprocket 36, which receives an endless chain 38.

Figure 2:
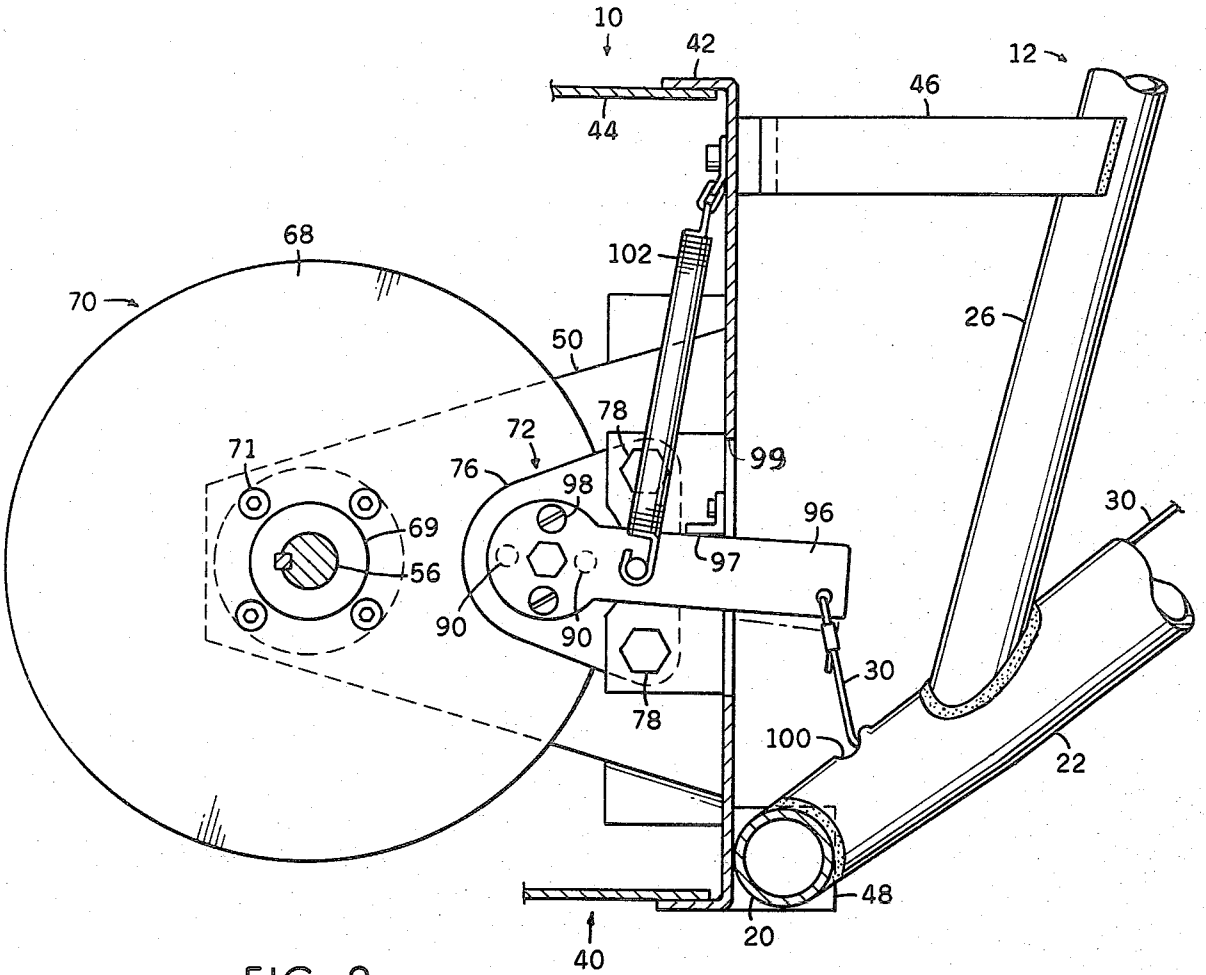
FIG. 2 is a sectional elevational view taken on line 2—2 of FIG. 1 illustrating the disc brake.

As shown in FIGS. 1 and 2, the drive resistance assembly 10 includes a housing 40 consisting essentially of a generally upright base member 42 and a removable cover 44. The base member 42 is attached to the exercise bicycle frame member 26 by means of an upper brace member 46, attached to the frame member 26, and lower bracket members 48 attached to the frame transverse bar 20. The base member 42 also provides a support means for the components of the drive resistance assembly 10 which will now be described.

As shown in FIG. 1, the housing base member 42 is provided with a pair of spaced brackets 50 and 52 attached thereto as by fasteners 54, said brackets providing a mounting for a main shaft 56 received within journals 57 provided on each of said brackets.

The shaft 56 is provided with a torque limiter assembly 58 of the type marketed by Browning Manufacturing, a division of Emerson Electric Co., of Maysville, Ky. The torque limiter assembly 58 includes a hub 59 keyed to the shaft 56 and carrying a sprocket 60 disposed between spaced sets of bearings and discs 61 and 62. The hub 59 includes a shoulder 63 and a washer spring 64 is disposed between said shoulder 63 and one of said discs 61. An adjustable collar 65 is threadedly received by the hub 59 and includes three circumferentially spaced cap screws 66. The spring pressure is adjusted to the desired torque value before slippage by backing-off the cap screws 66, adjusting the collar 65, and re-tightening the cap screws. The sprocket 60 receives the endless chain 38, and an opening 67 is provided in the base member 42 to receive said chain. By virtue of the torque limiter assembly 58, the sprocket 60 can move independently of the shaft 56 when the torque applied by the chain 38 is sufficiently great.

As best shown in FIGS. 1 and 2, the shaft 56 also carries a disc 68, which is attached by bolts 71 to a hub 69 keyed to the shaft 56, said disc forming part of a disc brake means, said brake means also including a caliper disc brake 72 attached to the base member 42 as by a U-shaped bracket 73.

The caliper disc brake 72 is of the type marketed by Tol-O-Matic of Minneapolis, Minn. under the trademark Tol-O-Matic. The brake 72 includes support arms 74 and 76 mounted to said U-shaped bracket 73 in floating relation by means of spaced bolts 78, said support arms 74 and 76 carrying fixed and adjustable brake pads 80 and 82 respectively. Support arm 74 includes a socket 84 receiving the pad 80 in removable relation. Support arm 76 also includes a socket 86 receiving the pad 82 in removable relation. Pad 82 is in register with pad 80, and similar to it except that pad 82 is lengthwise adjustable. The adjustment feature is provided by a camming means which includes a pair of cam follower pins 90 which are slidably mounted in the support arm 76. The pins 90 are fixedly attached at one end to a plate 88 which is engageable with the pad 82. At their other end, pins 90 are engageable by a rotatable V-notch cam member 91 which is mounted to a stud 92 fixedly attached to the support arm 76. The cam member 91 is retained on the stud 92 by means of a nut 93 and a return spring 94 is provided on the stud 92 between the cam member 91 and the support arm 76.

Figure 6:
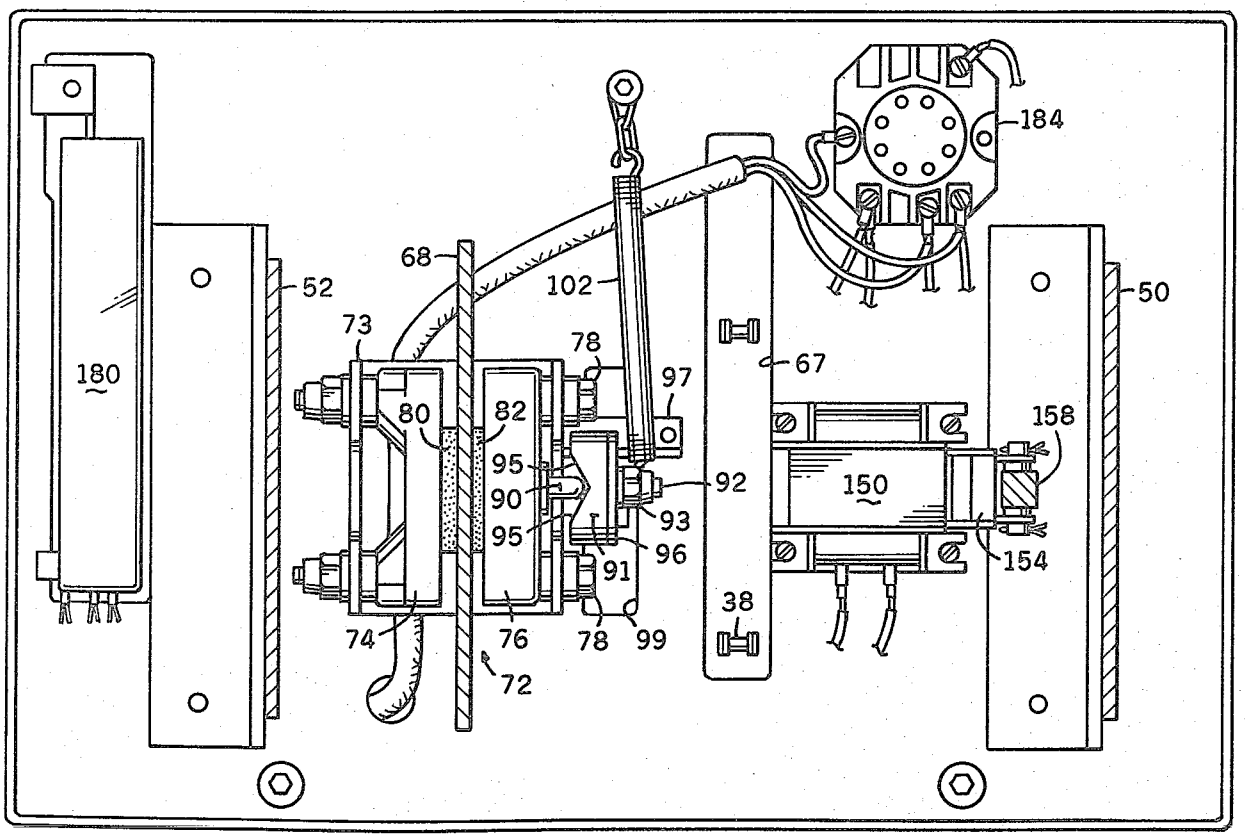
FIG. 6 is a cross-sectional view taken on line 6—6 of FIG. 1 illustrating the disc brake.

As shown in FIG. 6, the V-notch cam member 91 inclined cam faces 95 engage the cam follower pins 90 and move said pins, and the pad 82 operatively engaged therewith, inwardly when the cam member 91 is rotated, so that the brake pad 82 is urged into engagement with the disc 68. As shown in FIG. 2 the brake assembly cam member 91 is provided a radial arm 96 which is fixedly attached to the cam member 91 as by fasteners 98 and provides a means of rotating said cam member. The radial arm 96 is received through base member openings 99 and is connected at its outer end to the pull cord 30 which is received into the inclined frame member 22 as through a lipped aperture 100. As will be readily understood, the radial arm 96 is rotated in a clockwise direction by the application of a pull to the pull cord 30 against the tension of a return spring 102. The clockwise rotation of the cam member 91 (FIG. 1) by the radial arm 96 results in movement of the brake pad 82 into engagement with the disc 60, and the pull cord 30, radial arm 96 and camming members connecting said pad and arm provide a control means regulating the pedal pressure required to rotate the shaft 56. A stop element 97 (FIG. 2) fixedly attached to the base member 42 and engageable by the radial arm 96 provides a rotational limit to movement of said arm. The adjustable retaining nut 93 provides a means of adjusting the initial disposition of the cam member 91 to selectively determine the pressure applied by the brake pads 80 and 82 against the disc 68.

Figure 4:
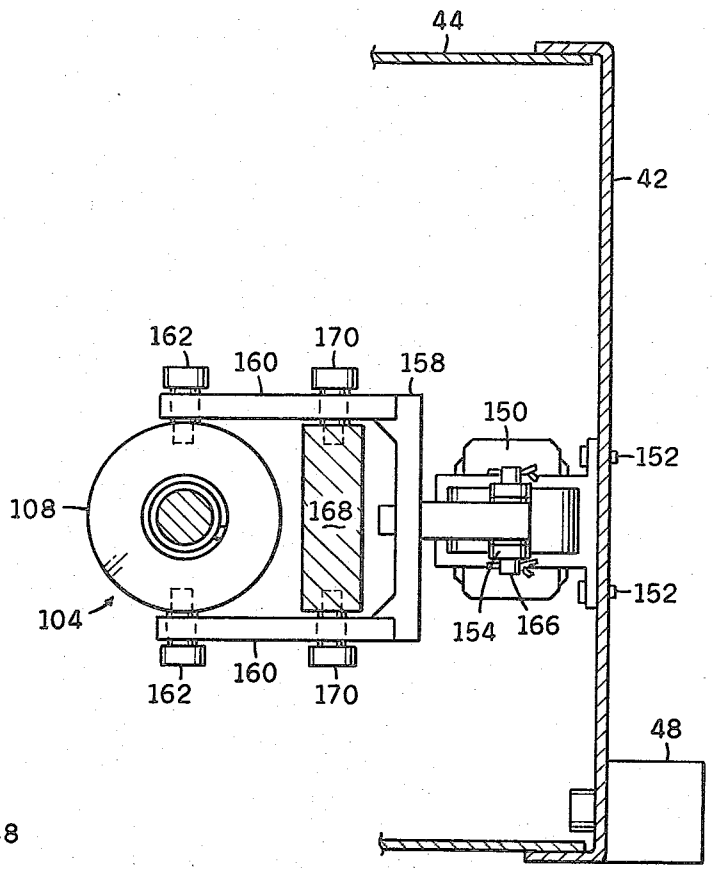
FIG. 4 is a sectional elevational view taken on line 4—4 of FIG. 1 illustrating the lock mechanism.
Figure 3:
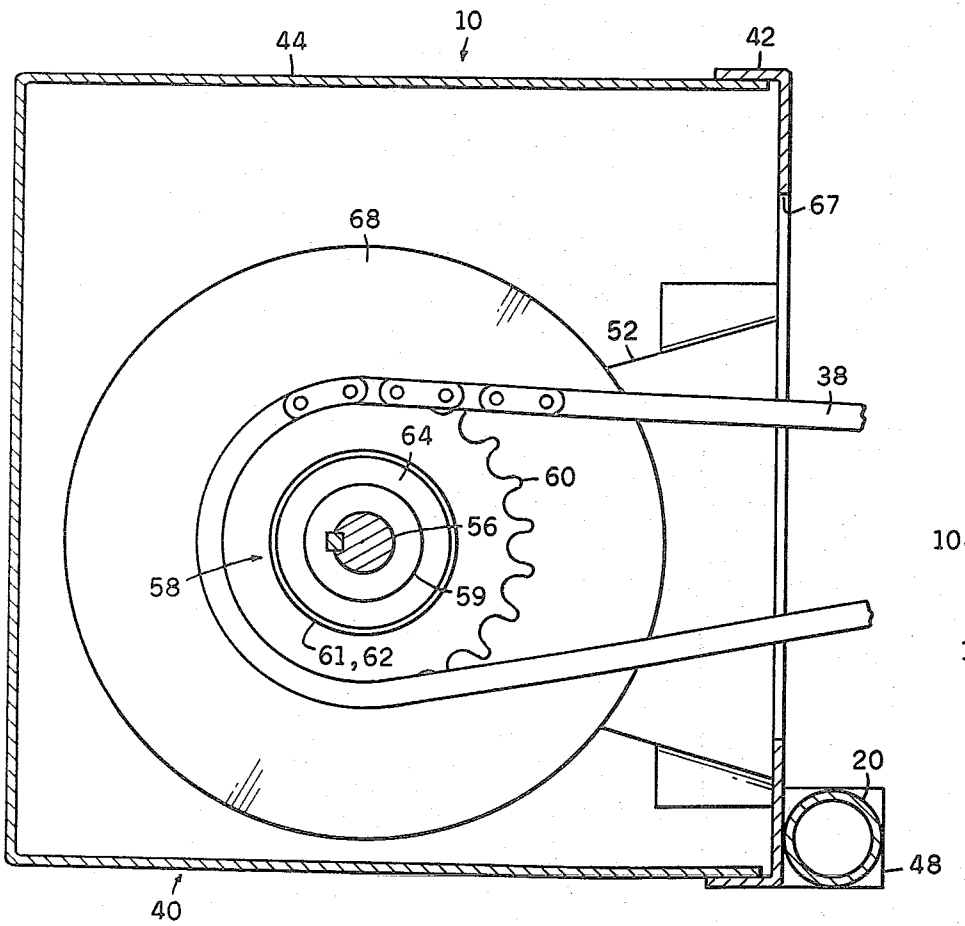
FIG. 3 is a sectional elevational view taken on line 3—3 of FIG. 1 illustrating the main shaft.
Figure 5:
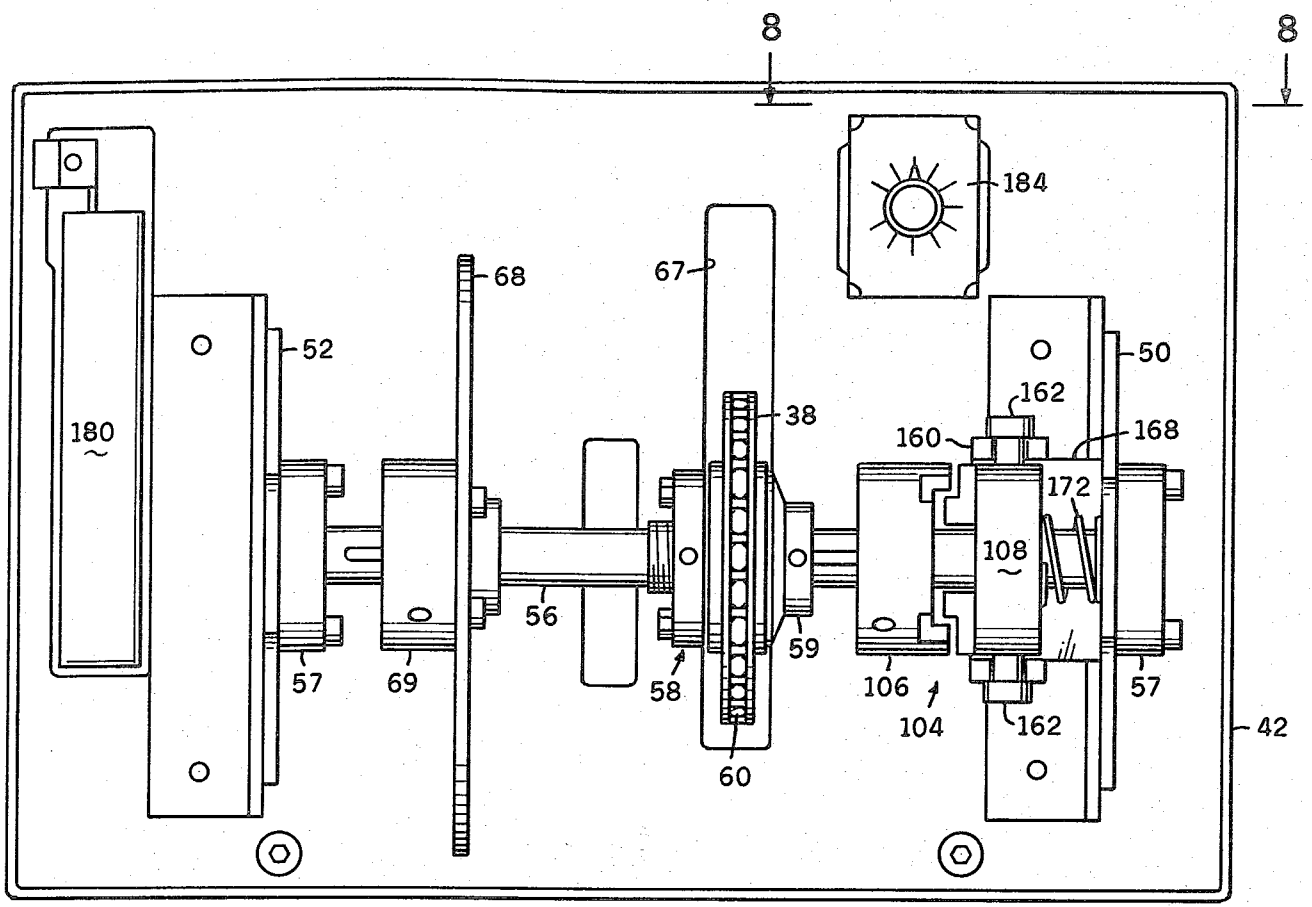
FIG. 5 is a sectional elevational view taken on line 5—5 of FIG. 1 illustrating the main shaft with the lock mechanism disengaged.

Importantly, the shaft 56 can be locked against rotation by a clutch lock assembly generally indicated by 104 which is best shown by reference to FIGS. 1 and 4. The clutch lock assembly 104 includes a fixed, female locking member 106, which is keyed to and rotatable with the shaft 56, and a movable, male, non-rotatable locking member 108. The male locking member 108 is slidingly mounted to the shaft 56 for engagement with said female member 106 to prevent rotation of said shaft 56, as will now be described with particular reference to FIGS. 11–13, and FIGS. 14–17A, FIGS. 13 and 14–17A being somewhat simplified for convenience. In the following description, it will be understood that where reference numerals are omitted, like parts are intended to be denoted by the same reference numeral.

Figure 12:
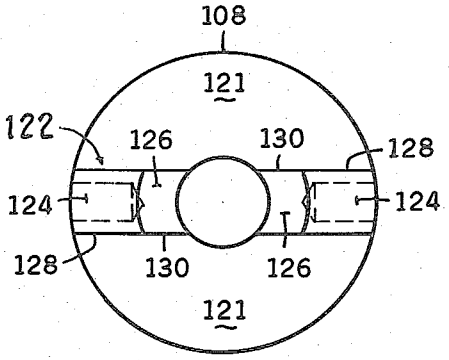
FIG. 12 is a view taken on line 12—12 of FIG. 10.
Figure 10:
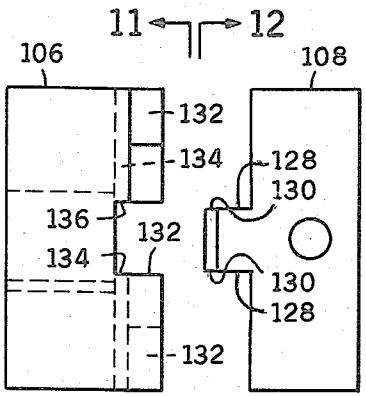
FIG. 10 is an enlarged plan view of the clutch lock member.
Figure 11:
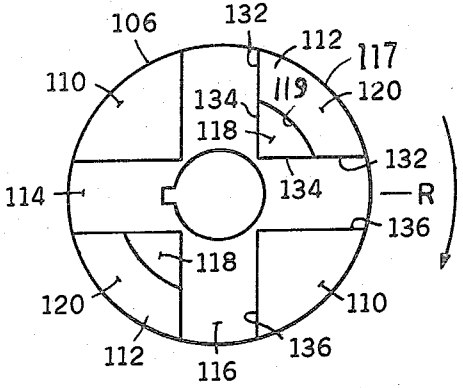
FIG. 11 is a view taken on line 11—11 of FIG. 10.
Figure 13:
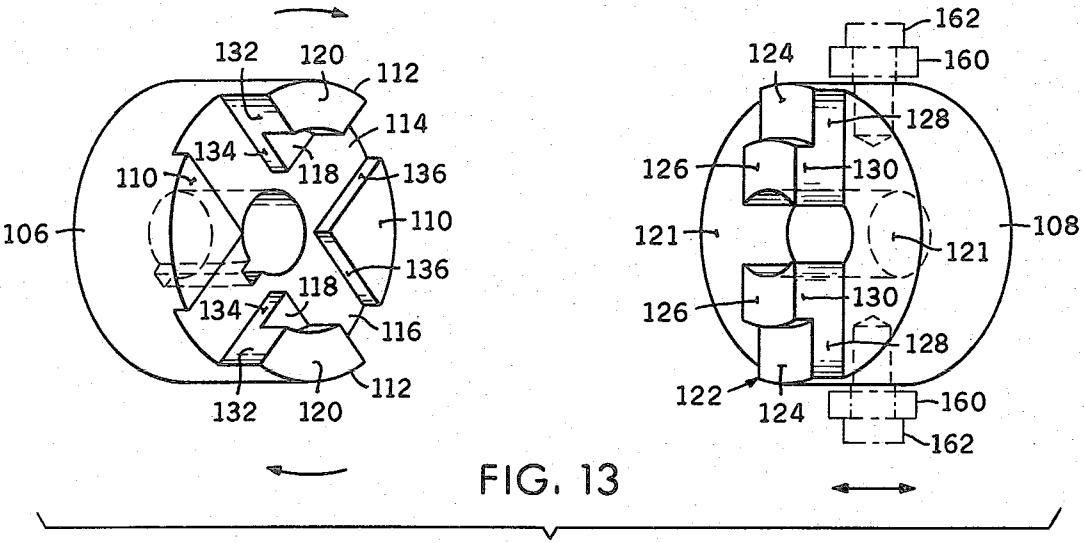
FIG. 13 is a simplified perspective view of the clutch lock members.

The female locking member 106, as shown in FIGS. 11–13, includes an engagement end face which is divided into diametrically disposed quadrants 110 and diametrically disposed quadrants 112 by perpendicularly related grooves 114 and 116. Quadrants 112 each include an inner portion 118 and an arcuate outer portion 120. The end faces of said inner portions 118 of quadrants 112 are in substantially the same plane as the end faces of said quadrants 110, and the end faces of said arcuate portions 120 of quadrants 112 are disposed outwardly of said plane a distance substantially twice the depth of the grooves 114 and 116 to provide abutments disposed adjacent the grooves connecting the inner and outer faces 119 and 117 of arcuate portions 120.

The male locking member 108 includes an engagement end face providing semi-circular faces 121 and an outstanding tongue member 122 which is slightly less in width than the grooves 114 and 116. The tongue member 122 includes outer portions 124 having a depth substantially equal to twice the depth of the grooves 114 and 116, and inner portions 126 having end faces disposed outwardly of the plane of the end faces of the outer portions 124 a distance substantially equal to the depth of said grooves 114 and 116. The diameter of the inner portions 126 is slightly less than the inner diameter of arcuate portions 112.

This structural arrangement of parts provides for interengagement of the tongue member side faces 128 and 130 by the quadrant side faces 132, 134 and 136 as is best understood by reference to FIGS. 14–17 and 14A–17A.

Figure 14A:
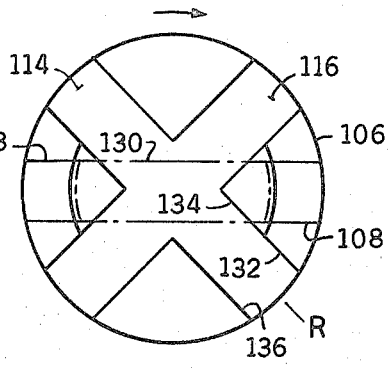
Figure 14:
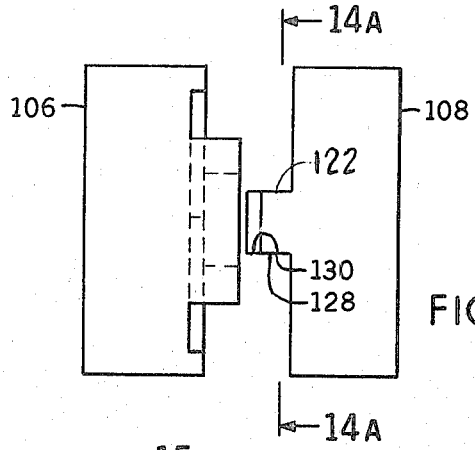
FIGS. 14–17 are simplified views similar to FIG. 10 but showing the clutch lock members in selected relative positions.

As shown in FIG. 14, non-rotating male locking member 108 is moving longitudinally toward the rotating but longitudinally stationary female locking member 106 which, it will be assumed, has rotated 45 from the position shown in FIG. 11 to the position shown in FIG. 14A as indicated by reference line R. The relative longitudinal position of the members 106 and 108 is shown in FIG. 14 in a first disposition of parts.

Figure 15A:
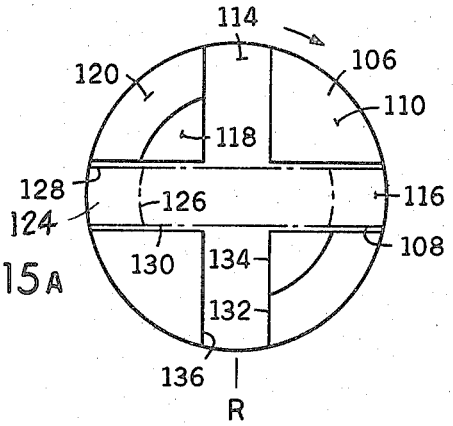
Figure 15:
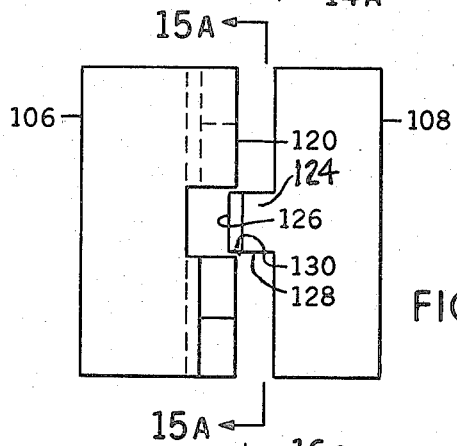

A second relatively advanced disposition of parts is shown in FIG. 15 in which the non-rotating male locking member 108 can continue to move longitudinally toward the rotating female locking member 106 even though said member 106 continues to rotate, for example to the position shown in FIG. 15A, and even through the planes of the end faces of the male members inner portion 126 and the female member arcuate portion 120 have crossed. This longitudinal movement is possible because the outer diameter of the tongue member inner portions 126 is less than the inner diameter of female member arcuate portions 120.

Figure 16A:
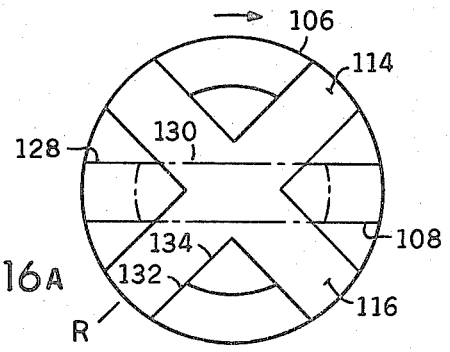
Figure 16:
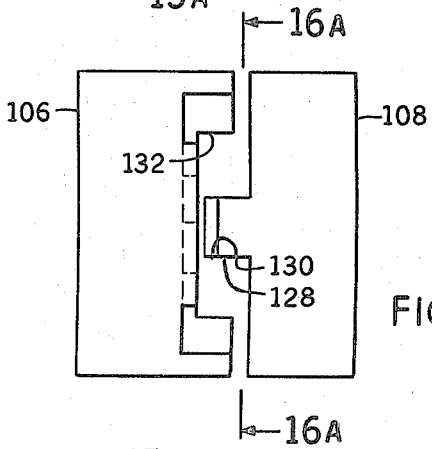

As shown in FIG. 16 in a third relatively advanced disposition of parts, the non-rotating male locking member 108 can continue to move longitudinally toward the rotating female locking member 106, even though said member continues to rotate, for example to the position shown in FIG. 16A, and even though the plane of the end faces of the tongue member outer portions 126 has crossed the plane of the end face of the female member arcuate portions 120, until such time as the abutment provided by side face 132 adjacent the groove engages a tongue member side portion 128. When this engagement occurs rotational movement of the member 106 is terminated abruptly and continued longitudinal movement of the male member 108 results in said tongue member outer portions 128 being received within one of the female member grooves 114 or 116, for example groove 114.

Figure 17A:
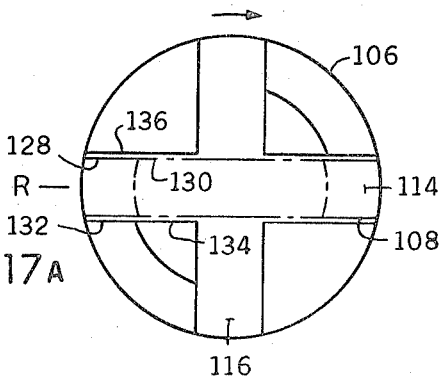
Figure 17:
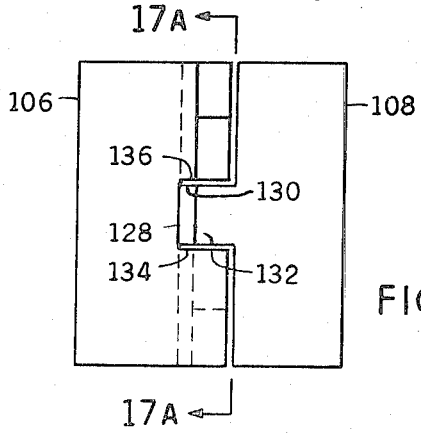

This condition is shown in FIGS. 17 and 17A and at this time the side faces 132 and 134 of the female member 106 have engaged the side faces 128 and 130 respectively of the male member 108, and reverse rotation of the female member 106 is prevented by engagement between the face 136 of female member 106 and faces 128 and 130 of male member 108. This structural arrangement of parts obviates the difficulty of engaging the tongue member 122 directly into one of the grooves 114 and 116 and yet permits initial engagement by tongue and groove parts having substantial strength.

As best shown in FIGS. 1 and 4 the clutch lock assembly 104 is actuated means of solenoid 150 attached to the housing base member 42 as by fasteners 152, said solenoid including a movable core 154 having a bifurcated end 156. The lock assembly 104 also includes a lever member 158 which interconnects the solenoid end 156 and the male locking member 108. The lever member 158, as shown in FIG. 4, includes a U-shaped portion 160, attached as by pivot fasteners 162 to the male locking member 108 and a tongue member 164 which is attached to the bifurcated end 156 of the solenoid movable core as by pivot fastener 166. As shown in FIG. 1, the lever member 158 is pivotally mounted to a pivot post 168, welded or otherwise fixedly attached to the shaft mounting bracket 50, as by pivot fasteners 170.

As will be readily understood axial movement of the solenoid core 154 moves the male locking member 108 into and out of engagement with the female locking member 106 thereby permitting or preventing rotation of the shaft 56. A compression return spring 172 tends to urge the locking members 106 and 108 into locking engagement.

Figure 7:
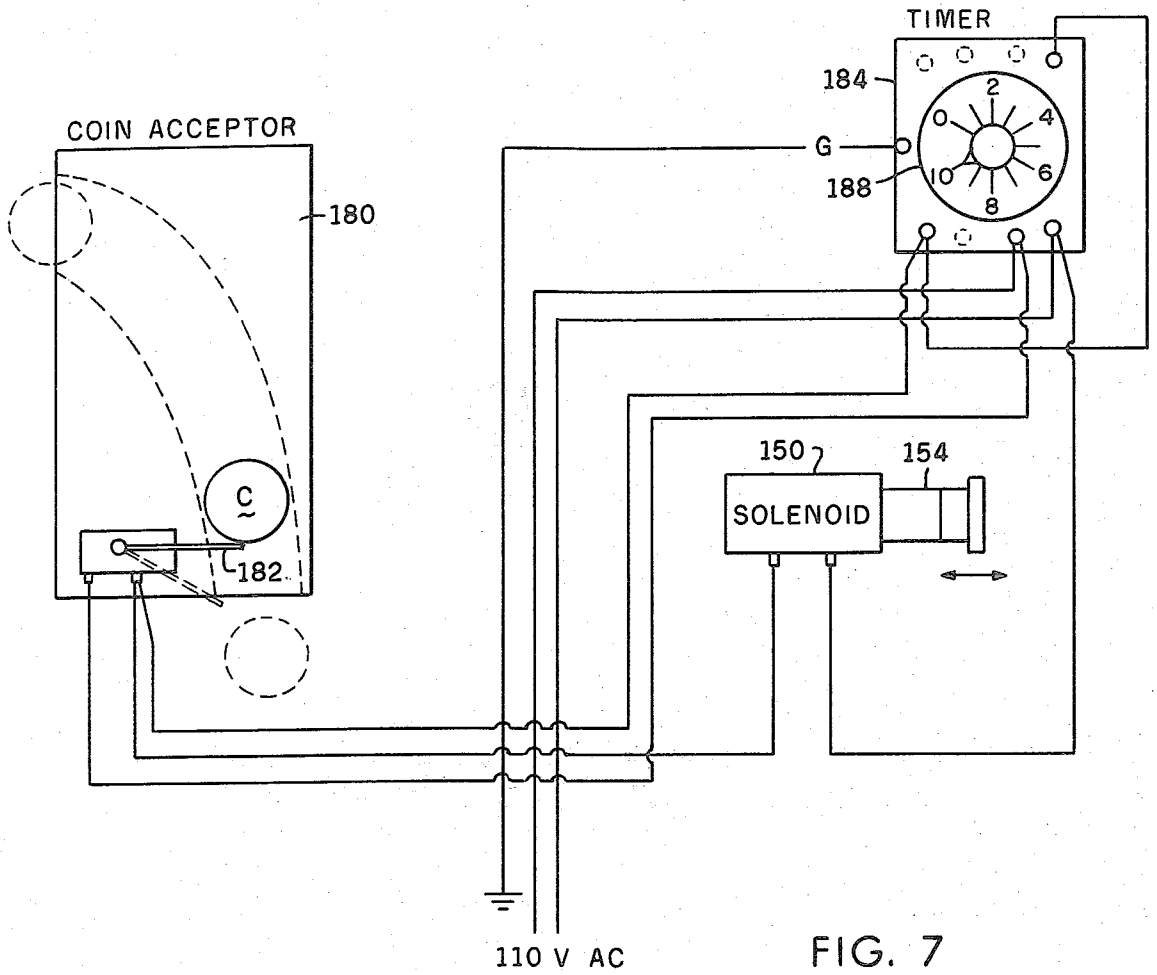
FIG. 7 is a schematic view of the coin acceptor and timer circuitry.

The solenoid 150 provides part of a coin-actuated switch assembly which is best shown by reference to FIGS. 6, 7 and 8. The switch assembly, which is shown schematically in FIG. 7 provides a means by which the solenoid movable core 154 is retracted to the position shown in FIG. 1 by the depositing of a coin C by an operator of the bicycle into the coin acceptor 180. The coin-actuated switch means also includes a timer 184 which, in the preferred embodiment, is disposed above the solenoid 150, and electrically connected between the coin acceptor 180 and the solenoid 150. The timer 184 is attached to the base member 42 as by fasteners 186, said timer providing a means for maintaining the lock assembly 104 in an unlocked position for a preselected period of time, said period being determined by the setting of the timer dial 188. Essentially, when the switch 182 is closed by the coin C a timer relay switch (not shown) is closed which places the solenoid 150 in the power circuit and energizes the solenoid thereby retracting the movable core 154 for a pre-selected period of time. When the time period expires the timer relay switch is again opened and the solenoid 150 de-energized to extend the movable core to its initial position until such time as another coin C is deposited in the coin acceptor 180.

It is thought that the structural features and functional advantages of this coin-operated exercise bicycle have become fully apparent from the foregoing description of parts, but for the completeness of disclosure the operation of the bicycle will be briefly described.

The exercise bicycle 12 shown in FIG. 9 is substantially conventional except for the provision of an idler gear 36 and a particular endless chain 38, which is connected to the drive resistance assembly 10 as well as to the front wheel 18. The resistance to the pedaling action of the operator is provided by the drive resistance assembly 10, rather than by a pressure roller brake applied to the front wheel 18 as is conventional.

In order to operate the bicycle 10, as best shown by reference to FIGS. 1 and 7, the operator places a coin C of the appropriate denomination in the coin box 180. Provided that the coin is accepted, the solenoid movable core 154 is retracted to the position shown in FIG. 1 such that the male locking member 108 is disengaged from the female locking member 106 keyed to the shaft 56, to permit said shaft to be rotated for a specific period of time, the duration of which is determined by the timer 184. During this period, the bicycle 12 may be pedaled by the operator, which causes the shaft 56 to rotate as well as the front wheel 18. The resistance to pedaling motion is provided to a small degree by the front wheel but primarily by resistance to rotation of the shaft 56, and the effort required to rotate said shaft is determined by the adjustable disc brake assembly 72 which is controlled by the operator.

The disc brake assembly 72 includes essentially a pair of floating brake pads 80 and 82 disposed on opposite sides of the rotatable disc 68, pad 82 being movable into engagement with the disc by rotating the radial arm 96, operatively connected to the movable brake pad 82 by the camming means. As shown in FIG. 2, the radial arm 96 is rotated by means of the pull cored 30 and, by virtue of a trigger 32 mounted to the handle bars 19 or a similar arrangement, the pull cord can be set to the position desired by the operator consistent with the operator's requirements. When the paid-for duration has elapsed, the spring-loaded solenoid core 154 moves outwardly and the male locking member 108 is urged into engagement with the female locking member 106 assisted by the return spring 172 mounted on the main shaft 56, thereby preventing further rotation of the shaft 56.

Importantly, in order to prevent a sudden stop to the motion of the bicycle pedal sprocket 34, the drive resistance assembly 10 includes a torque limiter 58 which is mounted to the shaft 56. By virtue of this torque limiter arrangement, the sprocket 60 mounted to the shaft 56 slips and continues rotation at a decellerating rate, thereby avoiding the sudden jolting stoppage which would otherwise occur. Thus as will be readily understood an effective lock means for the shaft 56 is provided by cooperation between the clutch lock assembly 104 and the torque limiter assembly 58.

I claim as my invention:

1. A driven resistance assembly for an exercise bicycle, the assembly comprising:

(a) support means, (b) coin-actuated switch means including a timer, (c) a shaft rotatively mounted to the support means, (d) brake means including first means on the shaft for selectively applying resistance to rotation of the shaft, (e) lock means actuated by the switch means and operatively disengageable with second means on the shaft to unlock the shaft on actuation by a coin, and (f) torque limiter assembly means on the shaft and drive assembly means on the shaft and drive means operatively connected between the exercise bicycle and torque limiter assembly means whereby on insertion of a coin the lock means is actuated to unlock the shaft for the duration of the time of the timer and the driven means can be actuated against the resistance of the brake means and on relocking of the shaft at the end of the time, the torque limiter assembly means allows slippage between the drive means and shaft at a decellerating rate thereby avoiding the sudden jolting stoppage which would otherwise occur.

2. A driven resistance assembly for an exercise bicycle as defined in claim 1, in which:

(g) the brake means includes:

1. the first means including a disc fixedly attached to the shaft and a brake pad mounted on the support means adjacent to the disc, and
2. control means selectively moving the pad translationally into engagement with the disc.

3. A driven resistance assembly for an exercise bicycle as defined in claim 2, in which:

(h) the control means includes a rotatable arm and connection means between the rotatable arm and the brake pad for moving the pad translationally into engagement with the disc.

4. A driven resistance assembly for an exercise bicycle as defined in claim 3, in which:

(i) the control means includes a flexible pull element, attached to the arm to move the arm in one direction, and a resilient means tending to urge the arm in the other direction.

5. A driven resistance assembly for an exercise bicycle, as defined in claim 1, in which:

(g) the second means includes a first locking member operatively mounted to the shaft for rotation therewith, and the lock means includes a second, non-rotatable locking member engageable with the first locking member to substantially preclude relative rotation of said first locking member when the switch means is no actuated.

6. A driven resistance assembly for an exercise bicycle as defined in claim 5, in which:

(h) the torque limiter assembly means includes a torque limiter operatively connected to the shaft, and (i) the drive means includes an endless flexible element operatively extending between the exercise bicycle and the torque limiter.

7. A driven resistance assembly for an exercise bicycle as defined in claim 5, in which:

(h) the torque limiter operatively connected to the shaft includes a sprocket rotatable relative to the shaft when the locking members are lockingly engaged, and (i) the drive means includes an endless chain operatively extending between the exercise bicycle and the sprocket.

8. A driven resistance assembly for an exercise bicycle as defined in claim 5, in which:

(h) one of said locking members includes an end face defining a groove disposed transversely of the axis of rotation of the shaft, and an abutment disposed adjacent the groove and projecting outwardly of said groove, and (i) the other of said locking members includes an end face defining a tongue disposed transversely of the axis of rotation of the shaft, said tongue being engageable with said abutment and being receivable within said groove.

9. A driven resistance assembly for an exercise bicycle as defined in claim 5, in which:

(h) one of said locking members includes an end face defining a pair of perpendicularly related grooves disposed transversely of the axis of rotation of the shaft, and a pair of diametrically oppositely disposed portions each having an abutment disposed adjacent each groove and projecting outwardly of said grooves, and (i) the other of said locking members includes an end face defining a tongue disposed transversely of the axis of the shaft, said tongue being engageable with opposed abutments and receivable within said groove therebetween.

10. A driven resistance assembly for an exercise bicycle as defined in claim 5, in which:

(h) one of said locking members including an end face defining a pair of perpendicularly related grooves disposed transversely of the axis of rotation of the shaft and a pair of diametrically oppositely disposed arcuate portions each having inner and outer arcuate faces and abutments connecting said arcuate faces, said abutments being disposed adjacent each groove and projecting outwardly of said grooves a distance equal to substantially twice the depth of said grooves, and (i) the other of said locking members including an end face defining a tongue disposed transversely to the axis of the shaft, said tongue having a width less than the width of the grooves, and including an outer portion having a depth equal to substantially twice the depth of said grooves and said tongue including an inner portion having end faces disposed outwardly of the plane of the end faces of the outer portions a distance substantially equal to the depth of the grooves and defined by arcuate faces having a diameter less than the inner diameter of the arcuate portion of the other locking member.

11. A driven resistance assembly for an exercise bicycle as defined in claim 5, in which:

(h) the lock means includes a lever attached to the second locking member for movement of said member into engagement with the first locking member.

12. A driven resistance assembly for an exercise bicycle as defined in claim 1, in which:

(g) the second means includes:

1. a first locking member mounted to the shaft for rotation therewith, the lock means includes,
2. a second locking member mounted on the shaft and not rotatable therewith and engageable with the first locking member to substantially preclude rotation of said first locking member,
3. a solenoid having a movable core, and
4. lever means pivotally mounted to the support means and connected between the solenoid core and the second locking member for moving said locking members out of engagement on actuation of the solenoid by the switch means.

13. A driven resistance assembly for an exercise bicycle as defined in claim 12, in which:

(h) the lock means includes resilient means tending to urge the second locking member into engagement with the first locking member.

14. A coin-operated exercise bicycle, comprising:

(a) a frame including a front fork portion, a rear support portion and an intermediate portion connecting said front and rear portions, (b) a wheel mounted to said front fork portion, (c) a pedal sprocket mounted to said intermediate frame portion, and (d) a driven resistance assembly including:

1. support means connected to the frame,
2. coin-actuated switch means including a timer means for temporarily maintaining said switch means in actuated condition,
3. A shaft rotatably mounted to the support means and carrying a sprocket mounted on the shaft by torque limiting means,
4. brake means including means on the shaft for selectively applying resistance to rotation of the shaft,
5. lock means normally engageable with a first locking member on the shaft to positively lock said shaft against rotation, said lock means operable by said switch means when in said actuated condition to disengage from said first locking member, and
6. chain drive means operatively extending between the pedal sprocket and the shaft sprocket.

15. An exercise bicycle as defined in claim 14, in which:

(e) the support means includes a generally upright base member, connection means between the base member and the frame intermediate portion, and connection means between said base member and said frame rear portion.

16. An exercise bicycle as defined in claim 14, in which:

(e)

1. the first locking member is operatively mounted to the shaft for rotation therewith and the lock means includes a second non-rotatable locking member engageable with the first locking member to substantially preclude relative rotation of said first locking member, and
2. the torque limiting means disposed between the shaft and the sprocket permits relative rotation of the sprocket and the shaft when the shaft is suddenly locked by deactuation of the lock means.

17. An exercise bicycle as defined in claim 14, in which:

(e) the brake means includes:

1. the means on the shaft being a disc fixedly attached to the shaft and a brake pad mounted on the support means adjacent the disc, and
2. control means including a rotatable arm, and connection means between the rotatable arm and the brake pad for moving the pad translationally into engagement with the disc, said control means also including a flexible element received by the intermediate frame portion and having a trigger attached to the front fork portion.

* * * * *